US006887119B2

(12) United States Patent
Bloeme et al.

(10) Patent No.: US 6,887,119 B2
(45) Date of Patent: May 3, 2005

(54) FLYING DISCS HAVING IMPROVED GRIPPING SURFACES AND FLIGHT PERFORMANCE

(75) Inventors: Peter R. Bloeme, Atlanta, GA (US); Jeffrey K. Perry, Cumming, GA (US)

(73) Assignee: Hyperflite, Inc., Atlanta, GA (US)

( * ) Notice: Subject to any disclaimer, the term of this patent is extended or adjusted under 35 U.S.C. 154(b) by 41 days.

(21) Appl. No.: 09/902,037

(22) Filed: Jul. 10, 2001

(65) Prior Publication Data

US 2003/0013373 A1 Jan. 16, 2003

(51) Int. Cl.[7] ..... A63H 27/00
(52) U.S. Cl. ..... 446/46
(58) Field of Search ..... 446/46, 47, 48; 244/153 R, 153 A; 473/588, 589

(56) References Cited

U.S. PATENT DOCUMENTS

| | | | | | |
|---|---|---|---|---|---|
| 3,942,567 | A | * | 3/1976 | Richilano | 30/50 |
| 4,157,631 | A | | 6/1979 | Kifferstein et al. | |
| 4,176,843 | A | * | 12/1979 | DeWitt, Jr. | 40/324 |
| 4,196,540 | A | | 4/1980 | Hembree et al. | |
| 4,204,357 | A | | 5/1980 | Harrington | |
| 4,207,702 | A | * | 6/1980 | Boatman et al. | 446/219 |
| 4,212,131 | A | * | 7/1980 | Ross, Jr. | 446/46 |
| 4,255,893 | A | * | 3/1981 | Anderson et al. | 446/48 |
| 4,265,454 | A | * | 5/1981 | Bayless | 446/48 |
| 4,334,385 | A | | 6/1982 | Melin et al. | |
| 4,425,734 | A | * | 1/1984 | Bauer | 446/48 |
| 4,516,947 | A | * | 5/1985 | Pircher et al. | 446/46 |
| 4,568,297 | A | | 2/1986 | Duniplace | |
| 4,681,553 | A | | 7/1987 | Rodarte | |
| D295,429 | S | | 4/1988 | Sandeen | |
| 4,737,128 | A | | 4/1988 | Moormann et al. | |
| 4,906,007 | A | | 3/1990 | Mitchell et al. | |
| D327,921 | S | | 7/1992 | Sobel | |
| 5,531,624 | A | | 7/1996 | Duniplace | |
| 5,540,610 | A | * | 7/1996 | Sneddon | 446/46 |
| D388,134 | S | | 12/1997 | Duniplace | |
| D401,288 | S | | 11/1998 | Duniplace | |
| D401,289 | S | | 11/1998 | Duniplace | |
| D406,282 | S | | 3/1999 | Pinguelo | |
| D414,823 | S | | 10/1999 | Gardner | |
| 6,179,737 | B1 | | 1/2001 | Adler | |
| 6,540,582 | B1 | * | 4/2003 | Primos et al. | 446/418 |

FOREIGN PATENT DOCUMENTS

WO WO 00/12423 * 3/2000

OTHER PUBLICATIONS

Dr. Stancil E. D. Johnson. Frisbee: A practitioner's manual and definitive treatise, 1975.*
International Search Report in PCT/US02/22774, applicant Hyper Flite, Inc.

* cited by examiner

*Primary Examiner*—Jacob K. Ackun
*Assistant Examiner*—Faye Francis
(74) *Attorney, Agent, or Firm*—Kilpatrick Stockton LLP

(57) ABSTRACT

A flying disc has a smaller diameter and lower profile which allow it to be more easily caught by dogs, children, and other less experienced players. The disc has an increased thickness and weight at the rim enabling the disc to travel greater distances. The disc has an increased thickness along a flight plate and along a transition area which helps deter puncture and other breakage due to aggressive canine catches. The disc has gripping surfaces positioned along an upper surface and on the underside of the disc which help a person retain better control of the disc while it is being thrown or caught. The gripping surfaces are segmented, staggered, unidirectional, and present a low profile. These gripping surfaces help prevent the accumulation of foreign matter that can render it difficult to grip or catch the disc and which can harm a dog's teeth when catching the disc.

3 Claims, 4 Drawing Sheets

FLYING DISCS HAVING IMPROVED GRIPPING SURFACES AND FLIGHT PERFORMANCE

FIELD OF THE INVENTION

The invention relates generally to flying discs and, more particularly, to discs intended to be thrown in the air and caught by people or canines.

BACKGROUND

Flying discs, such as the Frisbee® brand flying disc, have been around for years and are used by people of all ages. Flying discs are used for recreation purposes and are frequently seen on beaches, in the parks, yards, or even in the streets. In addition to purely recreational use, flying discs are also used in sports for competitive purposes. For example, flying discs are used in a golf-like game, disc golf, as well as in a football-like game, ultimate.

The popularity of flying discs is not limited to just people but also extends to canines. Many people enjoy tossing the flying disc to their dog and having their dog catch and retrieve the disc. Tossing the flying disc to a dog is therefore a recreational activity for both the person and the dog. Throwing discs to dogs has also developed into a competitive sport. In the United States, competitions are held in cities throughout the country and winners of such events can move on to regional and even international competition. Flying discs are therefore commonly caught by canines as well as people for recreation and competition.

A typical Frisbee® disc has a rim formed along the perimeter of the disc which then transitions into the flight plate. A set of annular ridges separated by grooves are formed along an edge of the flight plate in order to provide a gripping surface for the thrower. While this description is accurate for many flying discs, flying discs have been made with various other shapes as evident by the discs described in U.S. Pat. No. 4,568,297 to Dunipace, U.S. Pat. No. 4,618,553 to Rodarte, U.S. Pat. No. 4,906,007 to Mitchell et al., D327,921 to Sobel, and D406,282 to Pinguelo.

As mentioned above, a common feature in a typical flying disc is the set of ridges and grooves formed near an outer edge of the flying disc. These ridges provide a frictional surface and help the thrower retain his or her grip on the disc while it is being thrown. Unfortunately, dirt and other particulate matter can accumulate within the grooves between the ridges that can prevent the thrower from having a firm grip on the disc. The dirt and other particulate matter can also become firmly compacted within the grooves and difficult to remove. This dirt and other matter is a nuisance to a person and can have deleterious consequences in competition. For a dog catching the disc, the dirt and other matter can damage the dog's teeth and otherwise be harmful to the dog. Furthermore, these ridges extend substantially above the surface of the disc and have an adverse effect on the aerodynamic performance of the disc.

In addition to the above-mentioned problems with the ridges, many discs are also not suitable for use with dogs. A Frisbee® disc that has a bent rim or a punctured flight plate can be harmful to a dog catching that disc. The bent rim or puncture can present a jagged edge that can be harmful to the dog's mouth, such as to its teeth, gums, or tongue. In fact, some competitive rules in dog competition allow for the replacement of a disc if it becomes unsafe for the dog. If a disc does become unsafe, the time limit for the competition can continue to run while a line judge inspects and replaces the disc. Thus, for competition, the flying disc should be one that is less prone to rupture or breakage in order to maximize the number of throws within the set time limit. Flying discs made of harder and heavier materials would therefore help reduce occurrences of breakage or puncture. These heavier discs would also be beneficial in distance/accuracy rounds when extra points are awarded for longer throws. These heavier and harder discs, however, can also be harmful to the dogs since they present a larger mass which must be stopped by the dog's mouth.

A need therefore exists for improved flying discs that are better suited not only for people but also for canines.

SUMMARY

The invention addresses the problems mentioned above by providing discs offering improved performance. The discs according to one embodiment of the invention have an annular rim formed along an outer periphery of the disc, a flight plate in a central portion of the disk, and a transition area joining the rim to the flight plate. These discs have a first gripping surface formed in part of the transition area on an upper side of the disc and furthermore have a second gripping surface formed on a lower side of the disc in the transition area. By placing gripping surfaces on both the upper and lower surfaces of the transition area, a person throwing the disc is better able to grip and control it during play. These gripping surfaces also assist in the catching of the disc by presenting frictional surfaces that can be grasped by the catcher.

In a preferred embodiment, the gripping surfaces are segmented and also are staggered relative to each other. In contrast to conventional discs having a series of annular ridges with deep grooves, the gripping surfaces have a low profile and do not readily retain dirt and other foreign matter. These discs should therefore present fewer problems during competition since players should be able to grasp the discs better. The discs are especially well suited for canines since, by retaining less dirt and foreign matter, the gripping surfaces are less likely to damage the dog's mouth. The gripping surfaces are preferably uni-directional and provide a greater frictional force to movement along a radial direction than movement along a tangential direction along the disc.

The discs have other features that present advantages over conventional discs. For example, the annular rim is thickened as is the flight plate and transition area. The reinforced annular rim has a greater resistance to breakage due to such events as aggressive canine catches. The thickened flight plate and transition area also render the disc less susceptible to being damaged when used by canines. The disc preferably has a diameter less than 8.71 inches and the flight plate has a height preferably less than 0.781 inches. The disc therefore presents a lower profile than many conventional canine discs, which allow the disc to encounter less aerodynamic drag. The disc advantageously has a greater concentration of weight along the rim which enables the disc to be thrown farther distances. The disc also preferably has a ratio of its diameter to a height of the flight plate of less than approximately 9 to 1. It should be understood that these dimensions and ratios are exemplary and that discs according to the invention may have different dimensions and proportions.

BRIEF DESCRIPTION OF DRAWINGS

The accompanying drawings, which are incorporated in and form a part of the specification, illustrate preferred embodiments of the present invention and, together with the description, disclose the principles of the invention. In the drawings.

DETAILED DESCRIPTION

Reference will now be made in detail to preferred embodiments of the invention, non-limiting examples of which are illustrated in the accompanying drawings.

Figure 1A:
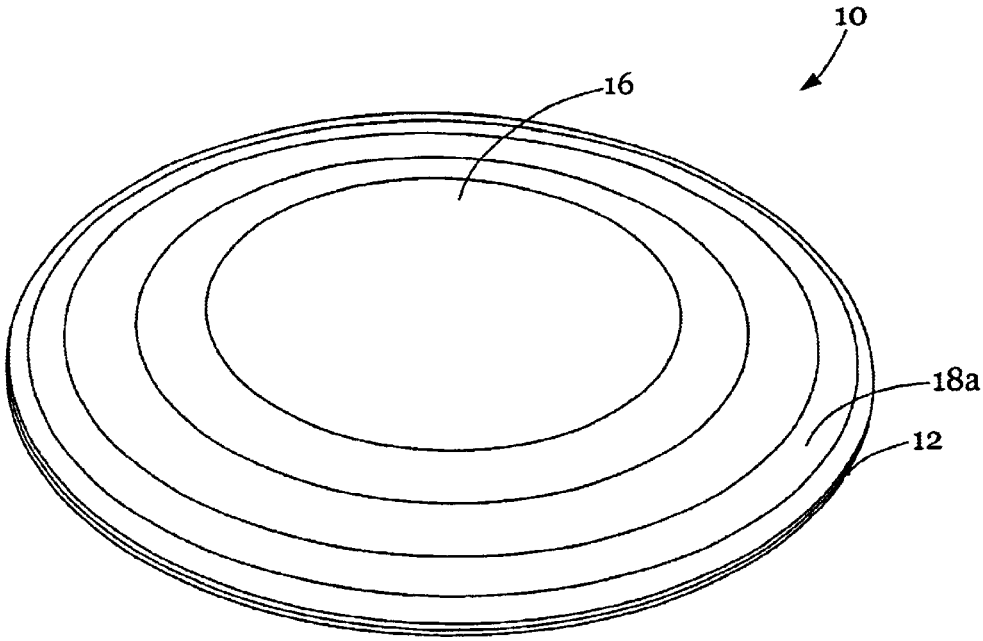
FIG. 1(A) is a perspective view of a disc according to a preferred embodiment of the invention.
Figure 1B:
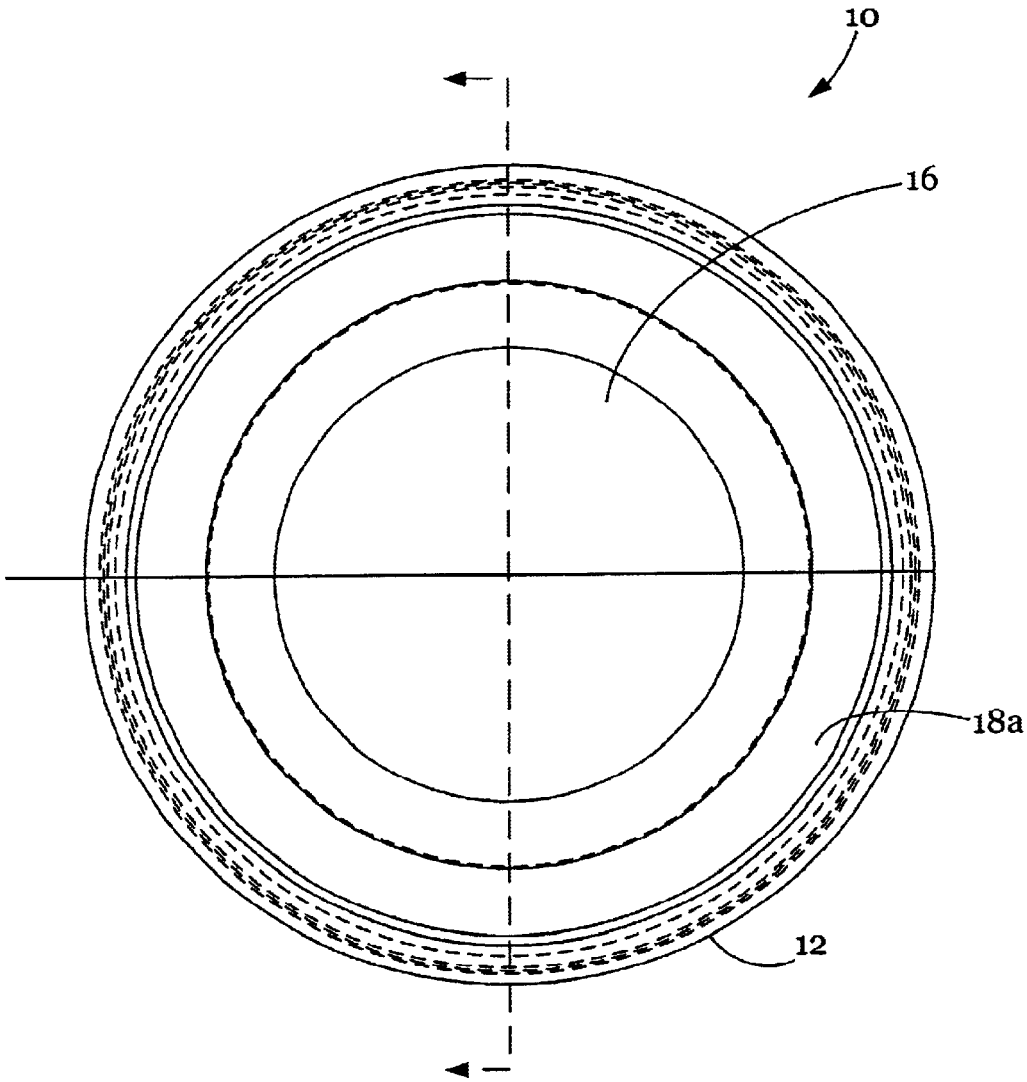
FIG. 1(B) is a top view of the disc.
Figure 1C:
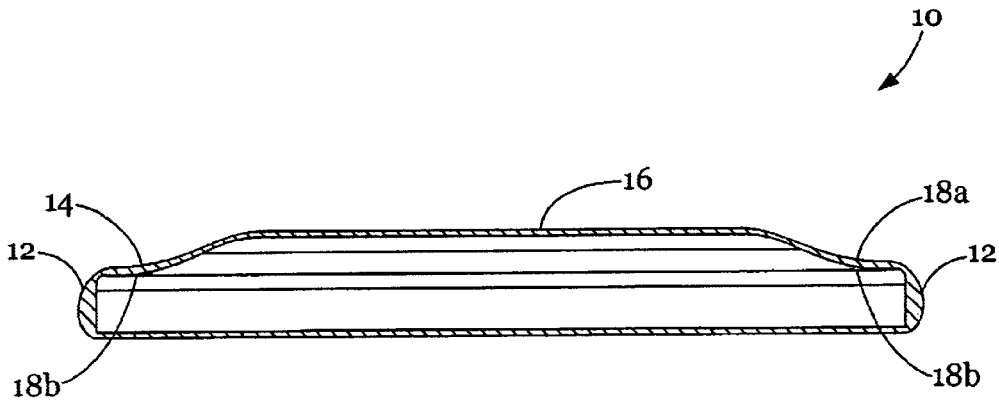
FIG. 1(C) is a cross-sectional side view of the disc.

A flying disc 10 according to a preferred embodiment of the invention is shown in FIGS. 1(A) to 1(C). The flying disc 10 is comprised of a rim 12, a flight plate 16, and a transition area 14 between the rim 12 and flight plate 16. A gripping surface 18*a* is formed in the transition area 14 on the top of the flying disc and a gripping surface 18*b* is also formed on a bottom side of the transition area 14.

As best seen in FIG. 1(C), the rim 12 has an increased thickness relative to other parts of the flying disc 10. This increased thickness at the rim 12 provides for a greater concentration of weight along the edges of the disc 10. The thicker area near the rim 12 lessens the likelihood of the rim 12 breaking, such as due to flexion in the rim 12 resulting from aggressive canine catches and powerful canine jaws. The thickened rim 12 also enables the flying disc 10 to travel greater distances.

As mentioned above, the rim 12 has an increased thickness which, in part, helps reduce the likelihood of it flexing and breaking during usage. The flying disc 10 has other improvements that allow it to be stronger in key areas subjected to wear or stress failure induced by canine teeth or jaw force. For example, the flight plate 16 and the transition area 14 are made thicker than the flight plate of other canine competition discs. In the preferred embodiment, the thickness of the flight plate 16 and transition area 14 is 0.093 inches whereas the typical thickness of other canine competition discs is 0.046 inches. This extra thickness helps the flying disc 10 travel farther while maintaining its rotational energy, enabling the disc to slow down and hover after achieving longer flights. The flying disc 10 is preferably made of a low density polyethylene, although any other suitable material may be used.

The flying disc 10 has a lower profile than many conventional flying discs. In the preferred embodiment, the disc 10 has a diameter of about 8.781 inches, the rim 12 has a height of about 0.718 inches, and the height of the flight plate 16 relative to the bottom of the rim 12 is about 0.625 inches. A typical canine disc, in contrast, has a diameter of about 9.281 inches, has a rim with a height of about 0.687 inches, and the height of the flight plate relative to the bottom of the rim is about 0.625 inches. The reduced profile of the flying disc 10, in combination with the increased weight at the rim 12, enables the disc 10 to be thrown greater distances with less aerodynamic drag. The dimensions of the disc 10 are merely exemplary and may be varied from that provided in the preferred embodiment. The ratio of the height of the flight plate 16 relative to the diameter of the disc 10 is preferably limited to about 1 to 9

As mentioned above, the flying disc 10 also has gripping surfaces 18*a* and 18*b* which are located on both the upper and lower surfaces of the transition area 14. These "opposed" gripping surfaces 18 permit contact with all five fingers of a thrower's hand when the disc 10 is thrown. For example, one manner in which the disc can be thrown is by positioning the thumb on gripping surface 18*a* and the four fingers on gripping surface 18*b* on the underside of the disc 10. Another manner in which the disc can be thrown is by positioning the thumb on the gripping surface 18*b* while placing the fingers on the gripping surface 18*a* on the upper side of the disc 10. Various other ways are known for grasping and throwing a flying disc. As evident by the two ways discussed above, placing the gripping surfaces 18 on opposite surfaces of the disc 10 allows a thrower to have a better grip on the disc, which should result in more spin for stability, in better accuracy, and increased distances when thrown. The gripping surfaces 18 also aid in catching the disc.

The preferred gripping surfaces 18 are preferably comprised of a low-profile segmented pattern that reduces the tendency of the gripping surface 18 to collect and retain foreign particles, such as dirt and other particulate matter. The gripping surface 18 is furthermore both segmented and staggered, as opposed to being continuous such as the annular ridges and groves in a typical flying disc, so that any foreign particle that might be present on the gripping surface 18 can be easily cleaned and removed. The segmented and staggered gripping surface 18 therefore does not have a tendency to trap foreign matter as is the case with a grooved gripping surface employed in many conventional discs.

The gripping surfaces 18 offer a number of advantages over disc with other gripping surfaces. For example, as mentioned above, by presenting the gripping surfaces 18 on opposing surfaces of the disc 10, the disc 10 can be more firmly held and thrown than other discs. Also, because the gripping surfaces 18 preferably use a segmented and staggered pattern, foreign material is less likely to be retained on the surfaces 18, thereby reducing the likelihood of damage to a canine's mouth. Furthermore, the gripping surface 18*b* on the underside of the disc 10 has no significant aerodynamic effect on the disc's 10 flight characteristics since this surface 18*b* is not subjected to the flow of the relative wind as the disc 10 flies. The gripping surface 18*a* on the upper side of the disc 10 actually provides an aerodynamic benefit in that it serves as mini-vortex generators, disrupting the flow of air over the disc 10 in such a way as to improve the overall stability of the disc 10 without any meaningful increase in drag.

Figure 2:
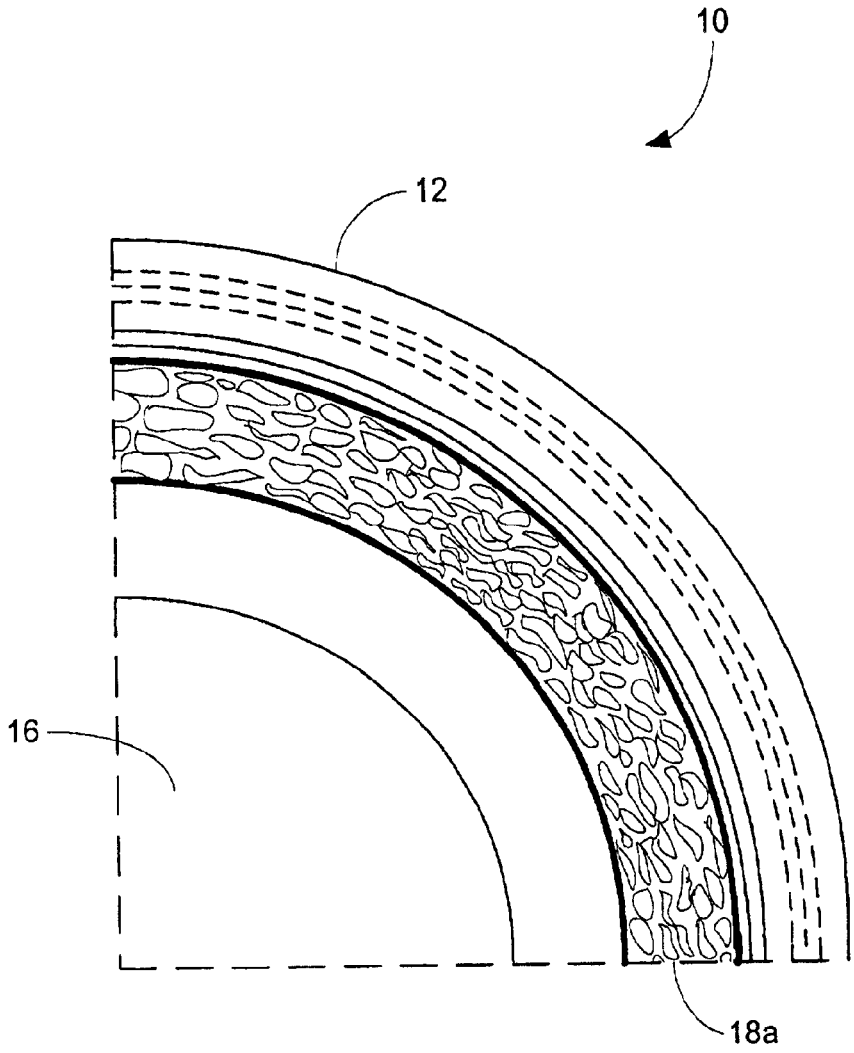
FIG. 2 is a partial enlarged view of the disc showing a preferred texture for a gripping surface.

In addition to being segmented, staggered, and having a low-profile, the gripping surfaces 18 are preferably uni-directional. The gripping surfaces 18 are uni-directional in that the surfaces 18 provide a greater frictional force for movement in a radial direction than movement in a tangential direction along the disc 10. The orientation of the pattern forming the gripping surfaces 18 advantageously serve as a gripping surface for the thrower yet are not sized or shaped to retain foreign matter. An example of a preferred texture for the gripping surfaces 18 is shown in FIG. 2. This pattern is provided by Plastic Products Unlimited, Inc. of Austell, Ga. and is texture no. 11375. As is evident from FIG. 2, the texture is comprised of a number of segments that are staggered relative to each other and also are oriented in one general direction. It should be understood that the texture shown in FIG. 2 is just one example and that various other textures or patterns may be used for the gripping surfaces 18.

The flying disc 10 is found to offer a number of improvements over existing flying discs. For example, the disc 10 is found to travel approximately 10 to 20 percent further than other canine discs when thrown under similar conditions. The opposed gripping surfaces 18*a* and 18*b* are believed to contribute to the ultimate distance achieved in the throws. Also, tests of the flying disc 10 with canines confirm the strength of the disc 10 and verify that the gripping surfaces 18 do not retain grit and other foreign matter that tend to have an abrasive effect on canine teeth.

Another advantage of the flying disc 10 is that it is more easily caught by dogs, especially smaller dogs. The disc 10 has a smaller diameter than typical canine discs and can therefore be more easily caught and carried by smaller dogs. Furthermore, the disc 10 has a lower profile and presents more of a sloping surface to dogs, which again is more easily caught and carried by a dog. The smaller size of the disc 10, however, is compensated by the increased weight along the rim allowing the disc 10 to travel greater distances than comparably sized discs even though it is lighter in weight. In addition to dogs, especially smaller dogs, the disc 10 is also better suited to children and inexperienced players. The disc 10 is smaller and lighter in weight and is therefore more easily handled by children and less experienced players. Furthermore the opposed gripping surfaces 18*a* and 18*b* assist these players in both gripping the disc while throwing it and also in catching the disc. The disc 10 therefore has a number of advantages over conventional discs.

The foregoing description of the preferred embodiments of the invention has been presented only for the purpose of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated.

What we claim:

1. A flying disc adapted to be thrown by humans and caught by dogs, the disc including:

a. a rim;

b. a flight plate;

c. a transition area located between the flight plate and the rim;

d. a top side;

e. a bottom side;

f. a first gripping surface formed in the transition area on the top side of the disc;

g. the first gripping surface including a pattern of low-profile, staggered, noncontinuous segments which do not form a plurality of continuous annular ridges and grooves;

h. whereby the first gripping surface pattern comprises a plurality of vortex generators when the disc is in flight, and said pattern substantially fails to trap dirt and particulate matter.

2. A flying disc according to claim 1 further comprising a second gripping surface formed in the transition area on the bottom side of the disc, the second gripping surface including a pattern of low-profile, staggered, noncontinuous segments which do not form a plurality of continuous annular ridges and grooves;

whereby the second gripping surface pattern substantially fails to trap dirt and particulate matter.

3. A flying disc adapted to be thrown by humans and caught by dogs, the disc including a. a rim;

b. a flight plate;

c. a transition area located between the (light plate and the rim;

d. a top side;

e. a bottom side;

f. a first gripping surface formed in the transition area on the top side of the disc;

g. a second gripping surface formed in the transition area on the bottom side of the disc and opposed to the first gripping surface;

h. the first and second gripping surfaces each including a pattern of low-profile, staggered, noncontinuous segments which do not form a plurality of continuous annular ridges and grooves;

i. whereby the first gripping surface pattern comprises a plurality of vortex generators when the disc is in flight, and said pattern substantially fails to trap dirt and particulate matter; and j. whereby the second gripping surface pattern substantially fails to trap dirt and particulate matter.

* * * * *

UNITED STATES PATENT AND TRADEMARK OFFICE

CERTIFICATE OF CORRECTION

PATENT NO. : 6,887,119 B2 
DATED : May 3, 2005
INVENTOR(S) : Peter R. Bloeme and Jeffrey K. Perry It is certified that error appears in the above-identified patent and that said Letters Patent is hereby corrected as shown below:

Title page,
Item [56], References Cited, OTHER PUBLICATIONS, please insert the following:
-- 7 photographs of Discrockers frisbee® flying disc --

Signed and Sealed this

Twelfth Day of July, 2005

JON W. DUDAS
*Director of the United States Patent and Trademark Office*